United States Patent [19]

Schreder

[11] Patent Number: 4,788,414

[45] Date of Patent: Nov. 29, 1988

[54] RADIANT HEATING UNIT FOR COOKERS OR THE LIKE

[75] Inventor: Felix Schreder, Oberderdingen, Fed. Rep. of Germany

[73] Assignee: E.G.O. Elektro-Gerate Blanc u. Fischer, Fed. Rep. of Germany

[21] Appl. No.: 42,428

[22] Filed: Apr. 24, 1987

[30] Foreign Application Priority Data

Apr. 24, 1986 [DE] Fed. Rep. of Germany ..... 3613901

[51] Int. Cl.[4] ..... H05B 3/74

[52] U.S. Cl. ..... 219/464; 219/458; 219/460

[58] Field of Search ..... 219/464, 458, 459, 460, 219/461, 462, 463, 467

[56] References Cited

U.S. PATENT DOCUMENTS

| | | | |
|---|---|---|---|
| 3,355,575 | 11/1967 | Bassett, Jr. et al. | 219/467 |
| 3,567,906 | 3/1971 | Hurko | 219/464 |
| 3,612,827 | 10/1971 | Dills | 219/460 |
| 3,622,754 | 11/1971 | Hurko | 219/461 |
| 3,646,321 | 2/1972 | Siegla | 219/460 |
| 3,789,189 | 1/1974 | Fischer et al. | 219/461 |
| 3,797,375 | 3/1974 | Cerola | 219/460 |
| 3,885,128 | 5/1975 | Dills | 219/464 |
| 4,150,280 | 4/1979 | Hurko | 219/464 |
| 4,264,805 | 4/1981 | Traut | 219/458 |

FOREIGN PATENT DOCUMENTS

| | | | |
|---|---|---|---|
| 2165569 | 7/1973 | Fed. Rep. of Germany | 219/467 |
| 7702615 | 5/1977 | Fed. Rep. of Germany . | |
| 3037965 | 10/1982 | Fed. Rep. of Germany . | |
| 8329498 | 1/1984 | Fed. Rep. of Germany . | |
| 8336391 | 6/1985 | Fed. Rep. of Germany . | |

*Primary Examiner*—E. A. Goldberg
*Assistant Examiner*—Teresa J. Walberg
*Attorney, Agent, or Firm*—Steele, Gould & Fried

[57] ABSTRACT

In a radiant heater (1) a support tray (3) receiving the radiant heating elements (10, 11) and hotplate (4) are displaceable with respect to one another by sliding guides (27) immediately adjacent to hotplate (4) and are self-adjustably tensioned with respect to one another by tension springs that an insulating material bearing rim (9) of support tray (3) always reliably engages on the inside of hotplate (4). The thus formed, self-adjusting unit can be supported as an entity on base (6) by means of actuating spindles (31), so that its level can be adjusted at any time without impairing the engagement of support tray (3) on hotplate (4).

35 Claims, 7 Drawing Sheets

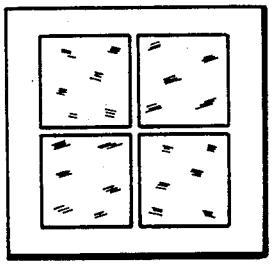
Fig. 3
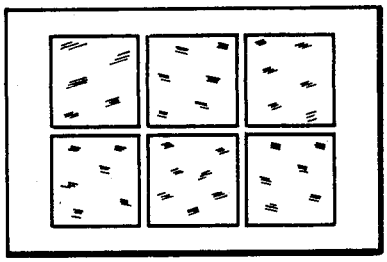
Fig. 6
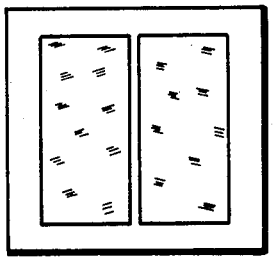
Fig. 4
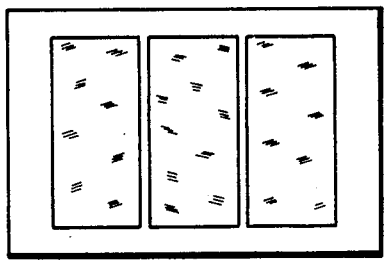
Fig. 7
Fig. 5
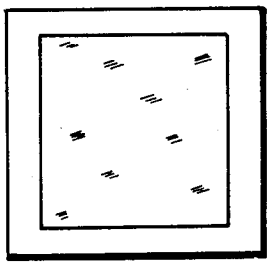

RADIANT HEATING UNIT FOR COOKERS OR THE LIKE

BACKGROUND OF THE INVENTION

1. Field of the Invention

The invention relates to a radiant heating unit for cookers or the like.

2. Prior Art

For a precise definition of the cooking field and for avoiding thermal leaks, in the case of such radiant heating units it is vital to ensure that the at least slightly flexible or resiliently compressible bearing rim of the support tray engages as durably and tightly as possible on the inside of the hotplate. However, as a result of its material characteristics, particularly with increasing aging the bearing rim tends to shrink or subside, so that reliable engagement on the hotplate can be impaired. Therefore spring loading has already been provided for radiant heaters in order to press the same against the hotplate. However, it has proved problematical to centre the radiant heater with respect to lateral movements, i.e. parallel to the hotplate, because a precise guidance of the radiant heater with respect to the base located beneath the radiant heaters and generally comprising crossmembers is difficult.

SUMMARY OF THE INVENTION

An object of the present invention is to provide a radiant heating unit of the aforementioned type, which in simple manner can be very accurately secured and aligned with respect to the hotplate.

In the case of a radiant heating unit of the aforementioned type, this is inventively achieved by the construction disclosed and claimed herein. The support tray can be laterally centred with the guide and can also be arranged or mounted in a permanently resiliently adjustable or displaceable manner roughly at right angles to the hotplate, so that a constantly effective sliding guide is formed. Thus, there is no need for a guide with respect to a base, i.e. the support tray or several juxtaposed support trays can be arranged in completely freely suspended manner on the bottom of a hob or freewardly outwardly projecting on the outside of a baking oven muffle wall and still permit adjustability of the support tray with respect to the associated hotplate. Thus, a considerable reduction in the overall constructional height of the apparatus unit comprising the radiant heater or heaters is obtained and there is no need for a base.

In the case of such radiant heaters, the hotplate is generally located in a frame of the associated apparatus unit which surrounds it, said frame being formed by the hob in the case of a cooker and by the muffle wall in the case of a baking oven muffle. According to the invention the sliding guide can be on the one hand provided between the hotplate and said frame by adjustable mounting of the hotplate with respect to the frame and on the other hand instead of this or in addition thereto between the support tray and the frame, as well as displaceably directly between the hotplate and the support tray, so that through a random combination of these three possibilities and using the same tension springs, numerous adaptations to different requirements can be obtained.

The heating resistors can be formed by encapsulated high temperature emitters, namely light bulbs or preferably bare, exposed heater coils or the like.

The inventive radiant heating unit is also suitable for heating a baking oven muffle and for similar purposes and in this case the hotplate at least partly forms one wall of the baking oven muffle.

For connection to the associated apparatus unit, the hotplate need not be directly rigidly fixed and can instead be secured in removable manner with respect to the apparatus unit, e.g. can be tensioned against the sealing profile or merely placed on the frame.

If there is a one-part, through hotplate for several cooking points or radiant heaters, appropriately on the inside or in the hotplate there are corresponding guides or sliding guides, which can e.g. be fixed by bonding, welding or the like to the hotplate. In each case, the sliding guide can be inwardly displaced with respect to the edge surface of the hotplate and/or with respect to the outside of the support tray formed by the circumference, so that it is completely located within the plan view of the hotplate, e.g. on the inside thereof. The associated end of the sliding guide is then appropriately directly or indirectly fixed with respect to the inside of the hotplate or the support by welding, bonding or the like.

Adjacent radiant heaters can be very closely juxtaposed, if the web-like sliding guide engages on the inside of the outer tray, so that there is no need for freely downwardly projecting sliding guide parts engaging over the outside of the support tray. Thus, the sliding guide can also engage angularly round the associated edge of the hotplate and adjacent sliding guides of adjacent radiant heaters can be formed in simple manner by a common frame profile, which e.g. simultaneously carries the two adjacent hotplates.

The support tray can form a preassembled, integrated component with the hotplate or with the frame carrying the hotplate or hotplates and which as a unit can be adjusted at right angles to its plane, i.e. in the insertion direction of the guides, e.g. for setting purposes, without the tension of the tension springs being influenced.

It is also conceivable for at least one tension spring, which is supported with respect to the base, to be preferably arranged in the form of a compression spring between the bottom of the outer tray and a base plate arranged on the associated side of the inner tray. In the case of a corresponding construction of the support tray, e.g. the inner tray and outer tray are displaceably guided with respect to one another in the guide displacement direction, as well as spring-loaded. In addition, the outer tray can be displaceably mounted in the guide located at the hotplate with respect thereto.

These and further features of preferred developments of the invention can be gathered from the description and drawings and the individual features can be realized in any embodiment of the invention and in other fields, either alone or in the form of subcombinations.

BRIEF DESCRIPTION OF THE DRAWINGS

Embodiments of the invention are described hereinafter relative to the drawings, wherein show:

FIGS. 3 to 7 Several embodiments for subdivisions of a hob into individual cooking points in a reduced-scale plan view.

DETAILED DESCRIPTION OF THE PREFERRED EMBODIMENTS

Figure 1:
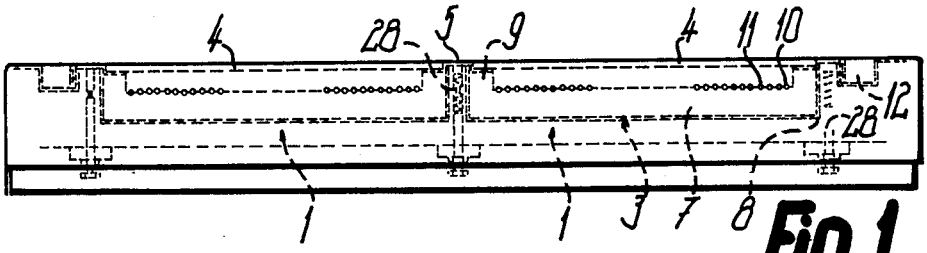
FIG. 1 A side view of a hotplate unit provided with radiant heaters according to the invention.
Figure 2:
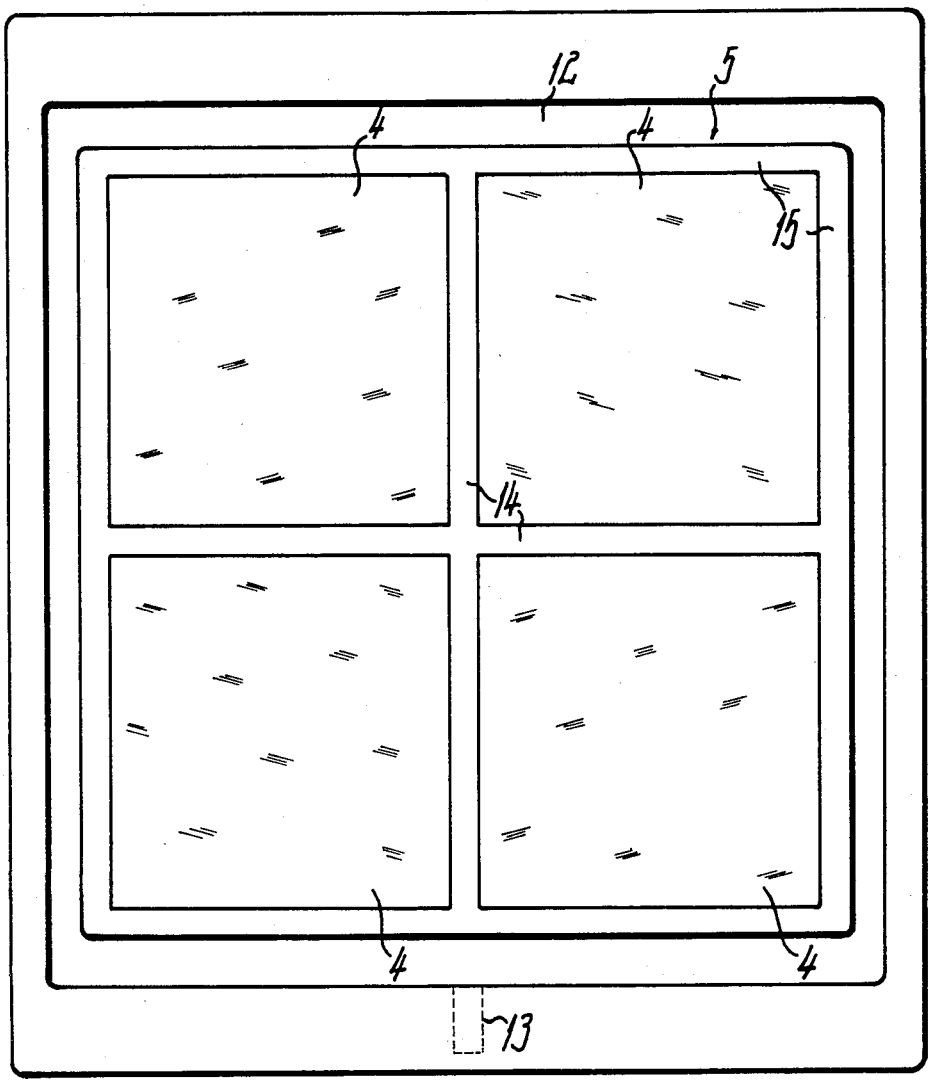
FIG. 2 The unit according to FIG. 1 in plan view.
Figure 8:
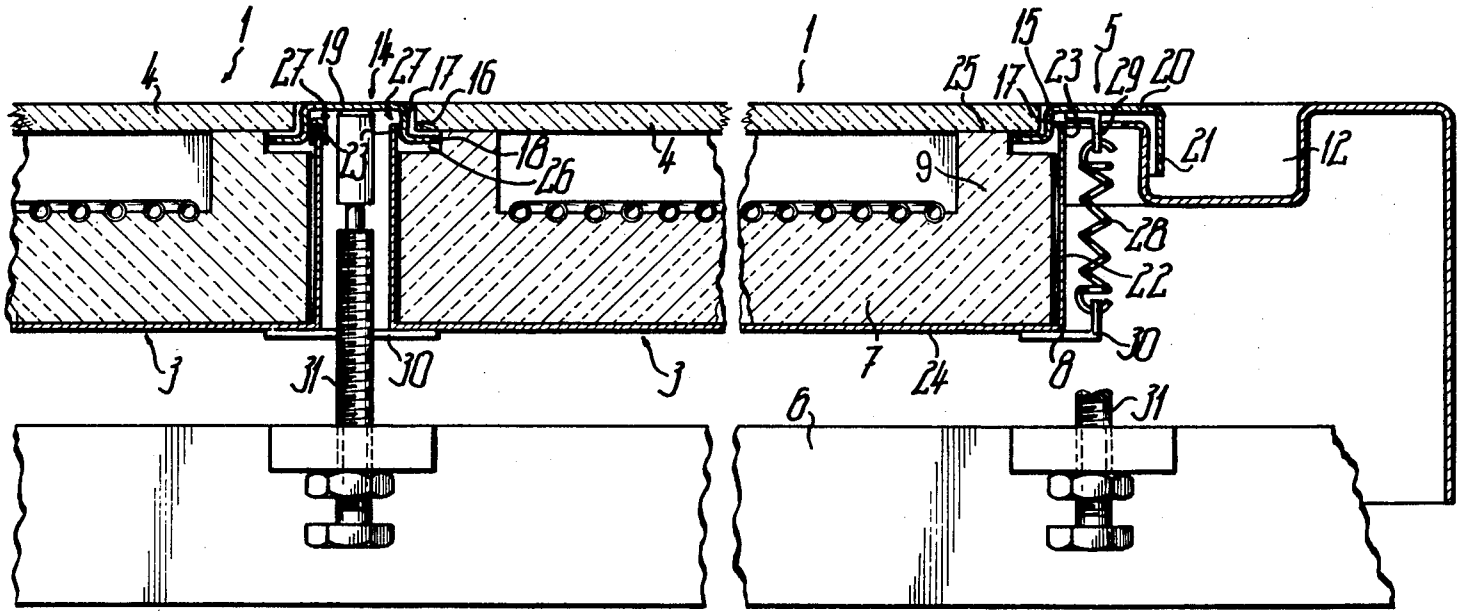
FIG. 8 A detail of FIG. 1 on a much larger scale and in a sectional representation at right angles to the hotplate.

As shown in FIGS. 1 and 2, generally several inventive radiant heaters 1 are combined into a heating or cooking point unit, which e.g. forms the upper part of a not shown cooker. Each radiant heater 1 has a support tray 3 located on the underside of a glass ceramic or similar hotplate 4 whose size corresponds thereto. Hotplates 4, in the form of individual plates are located in a frame 5, whose top surface is in the plane of the top of the hotplates 4. Radiant heaters 1, including frame 5 are supported on a flat base 6 formed from crossmembers or the like located beneath the same and which is in turn used for installing the cooking point unit in a cooker, a working plate or the like. As shown in FIG. 8, each support tray 3 has a relatively thick-walled inner tray 7 made from insulating material, e.g. moulded mineral fibres, vermiculite or the like, as well as a sheet metal outer tray surrounding the outer circumference and the underside of the bottom thereof and in which the inner tray 7 is arranged in substantially clearance-free manner in the lateral direction. The rim 9 of inner tray 7 which is set back with respect to the circumferential rim of outer tray 8 engages with pretension on the underside of the associated hotplate 4 around its whole area, along the end face of rim 9 in such a way that it only spacedly contacts hotplate 4 within the outer edge thereof, but adjacent thereto projects slightly outwards over said outer edge. One or at least two heating resistors 10, 11 in the form of bare, exposed heater coils laid spirally in interengaging spirals are provided on the bottom of the support tray 3 or inner tray 7. In the represented embodiment hotplates 4 are square, have the same size and are located with a relatively small intermediate gap adjacent to one another, so that four cooking points are formed. However, at least one hotplate, as well as the associated, remaining radiant heater could be circular, oval or the like. An all-round spillage or collecting channel 12 is provided around the field taken up by the cooking points or hotplates 4 and a drain 13 leads away from one side thereof. The spillage channel 12 is formed from frame parts separate from frame 5 and which in the height direction engage in position-variable manner in frame 5, but can be so covered by the latter that in any position any liquid flowing outwards over frame 5 can only pass into channel 12. The frame parts having the spillage channel 12 also form the upright outer shields of the cooking point unit.

The substantially rectangular frame having a central cross connection has different profiles on the frame webs 15, located on the outer rectangular sides, than on the inner frame webs 14, forming the cross connection. However, both outer frame webs 15 and frame webs 14 have in each case a profile web 17 parallel to the immediately adjacent edge surface 16 of particular hotplate 4 and in particular at right angles to the plane of hotplate 4 and a web leg 18 bent from the same and engaging behind the underside of the associated hotplate 4, so that the latter is circumferentially surrounded by angle profiles or sections of the frame webs 14, 15, relative to which the hotplate 4 can be secured in flush manner by bonding. At the upper end, each profile web 17 passes into a cover web 19 or 20 bent therefrom and whose planar top surface is roughly in the plane of the top of the hotplates. In the case of the central frame webs 14, cover web 19 connects two profile webs 17 for adjacent hotplates 4, whilst in the case of frame webs 15, cover web 20 on its outer rim remote from the associated profile web 17 passes into a downwardly bent outer web 21, which engages over the inside of the side wall of collecting channel 12 located closer to hotplates 4.

The sheet metal outer tray 8 of each radiant heater 1 has a substantially planar bottom 24 engaging in whole-surface manner on the associated side of the inner tray 7 and which passes into an outer jacket 22 roughly at right angles thereto, whose end portion remote from bottom 24 forms an outer rim 23, which is at right angles to the hotplates 4 in the continuous extension of the remaining outer jacket 22. The outer rim 23 of outer jacket 22 engaging in substantially whole-surface manner on the outer circumference of inner tray 7 projects slightly further upwards than end face 25 of bearing rim 9 of inner tray 7. All the outer rims 23 extend with a limited bearing clearance up to the sides of the associated profile webs 17 remote from the particular hotplate 7, but have a relatively large distance between their end edges and the inside of the connecting cover web 19 or 20 and this can be roughly half the height of profile web 17. On the outside of bearing rim 9 remote from heating resistors 10, 11 there can be a step-like recess 26 connected to end face 25, so that the width of the engaging end face 25 in cross-section is approximately half as wide as the entire bearing rim 9. The width of recess 26 is adapted to the width of web leg 18, whilst its height is at least as great as the spacing of outer rims 23 from cover webs 20, 21.

As a result of the described construction a sliding guide 27 is formed for each support tray 3 by which it is mounted with its outer edges 23 on profile webs 17 at right angles to hotplates 4 so as to be secured in substantially clearance-free manner against lateral movements and displaceable by the amount by which the bearing rim 9 can subside by compression in the vicinity of end face 25. Between profile webs 17 and the outer edges 23, it is additionally possible to provide a sliding seal or packing in the form of a suitable sealing profile or a permanent elastic seal adhering to both parts and which yields over the relatively small displacement path.

Support tray 3 is pretensioned against hotplate 4 with tension springs 28 uniformly distributed over its circumference and e.g. four such springs located in the vicinity of the corners thereof, whereof only one is shown in FIG. 8. The tension springs 28 in the form of spiral tension springs are located on the insides of cover webs 19, 20 with an alignment at right angles to hotplates 4 and are in each case hung in an angular holder 29 fixed to said inside on the one hand and in an angular holder 30 on the other, which is fixed to the underside of bottom 24 and projects over the outside of outer jacket 22. Thus, each tension spring 24 is immediately adjacent to the outside of outer jacket 22 and parallel thereto, the angle legs of holders 29, 30, in which the tension springs 28 are hung are directed against one another.

Inner tray 7 can be constructed in one-part or multi-part manner and in the latter case has at least one or two bottom layers and also the bearing rim 9 can be formed by a separate ring engaging on the associated bottom layer. Thus, the bearing rim 9 can be made from a different insulating material, such as vermiculite particularly suitable for engaging on hotplate 4, whilst the base plate can be made from an insulating material, such as a mineral fibre material suitable for mounting the heating resistors 10, 11 by embedding, as well as for high thermal stresses.

Threaded actuating spindles 31 are guided at right angles to hotplates 4 on base 6 and the free ends thereof are supported adjacent to or between tension springs 28 on the insides of cover webs 19, 20. By adjusting actuating spindles 31, it is possible to adjust the level of the unit comprising hotplates 4, frame 5 and support trays 3 and said spindles 31 can also absorb high weight forces, which can be transferred to base 6, so that frame 5 does not have to have particularly thick cross-sections.

The subdivision of the cooking field of the cooker can take place in different ways in accordance with requirements. FIG. 3 shows an arrangement according to FIG. 2 with four equally large, square and directly adjacent cooking points. FIG. 4 shows two elongated, rectangular, directly juxtaposed cooking points, whose longer extension is directed in the depth direction of the cooker, the length of the cooking points being roughly twice as large as their width. FIG. 5 shows a cooker, in which a single cooking point takes up the entire cooking field, said cooking point being substantially square. As shown in FIG. 6, there can be more than two juxtaposed, namely e.g. three juxtaposed cooking points in at least two rows, so that there are in all at least six directly adjacent square or similar cooking points. According to FIG. 7 there are three parallel, directly adjacent, elongated, rectangular cooking points for forming the cooking field.

In FIGS. 8 to 13 corresponding parts are given the same reference numerals, but are followed by different letter references in FIGS. 9 to 13.

Figure 9:
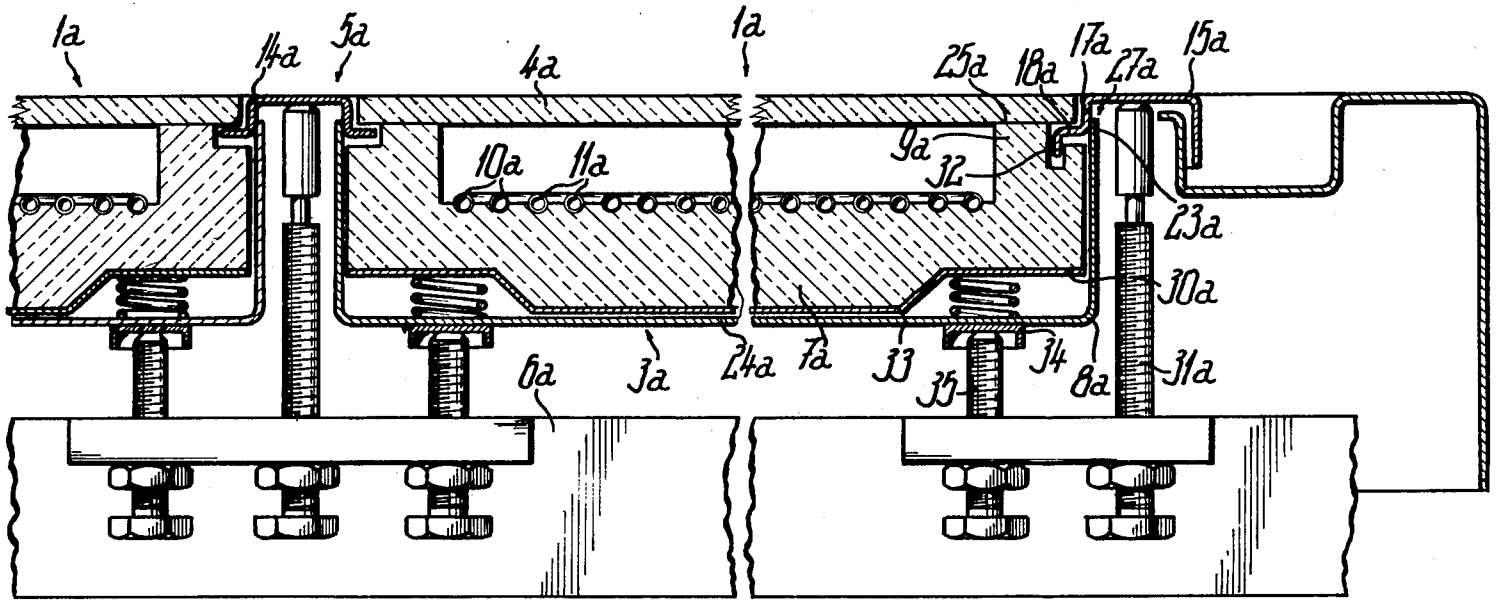
FIG. 9 Another embodiment in a representation corresponding to FIG. 8.

As shown in FIG. 9, the particular web leg 18*a* can pass on its inner edge into a leg web 32 bent away from hotplate 4*a* which engages in a corresponding groove in or adjacent to the end face 25*a* of bearing rim 9*a* and contributes to a further stiffening of the profile or section carrying hotplate 4*a*.

The construction of support tray 3*a* essentially differs from that according to FIG. 8, because the inner tray 7*a* and the outer tray 8*a* are mutually displaceably guided at right angles to hotplate 4*a*, whilst in turn the outer tray 8*a* is displaceably guided on frame 5*a* via sliding guides 27*a*. On its underside, inner tray 7*a* has a bottom plate 33, which in the edge region is in the form of shoulder webs 30*a* for forming reception areas for tension springs 28*a* between bottom 24*a* and inner tray 7*a*. Tension springs 28*a* arranged between shoulder webs 30*a* and bottom 24*a* are constructed as compression springs, e.g. helical compression springs, but can also be leaf springs or the like. Apart from the actuating spindles 31*a*, there are threaded actuating spindles 35 parallel thereto and guided on base 6*a*, whose ends are roughly supported in the region on the outside of bottom 24*a*, in which there is in each case a tension spring 28*a* and in each case one spindle 35 and one spring 28*a* can be equiaxially arranged to one another. For better force distribution purposes, actuating spindles 35 are supported on bottom 24*a*, whilst interposing U-shaped intermediate profiles 34. In each case two adjacent actuating spindles 35 can engage on a common intermediate profile 34. In the vicinity of frame webs 14*a* a spindle 31*a* is positioned between two spindles 35, whilst in the vicinity of frame webs 15*a* only a single actuating spindle 35 is positioned adjacent to each actuating spindle 31*a*. If the actuating spindles 31*a* are adjusted, there is no need to adjust actuating spindles 35, because the frame 5*a* can be displaced with respect to outer tray 8*a* by means of sliding guides 27*a* and consequently there is also movement of the inner tray with frame 5*a* or hotplate 4*a* because inner tray 7*a* is displaceably mounted on outer tray 8*a* by means of a corresponding sliding guide and is prestressed by tension springs 28*a* in the adjustment direction.

Figure 10:
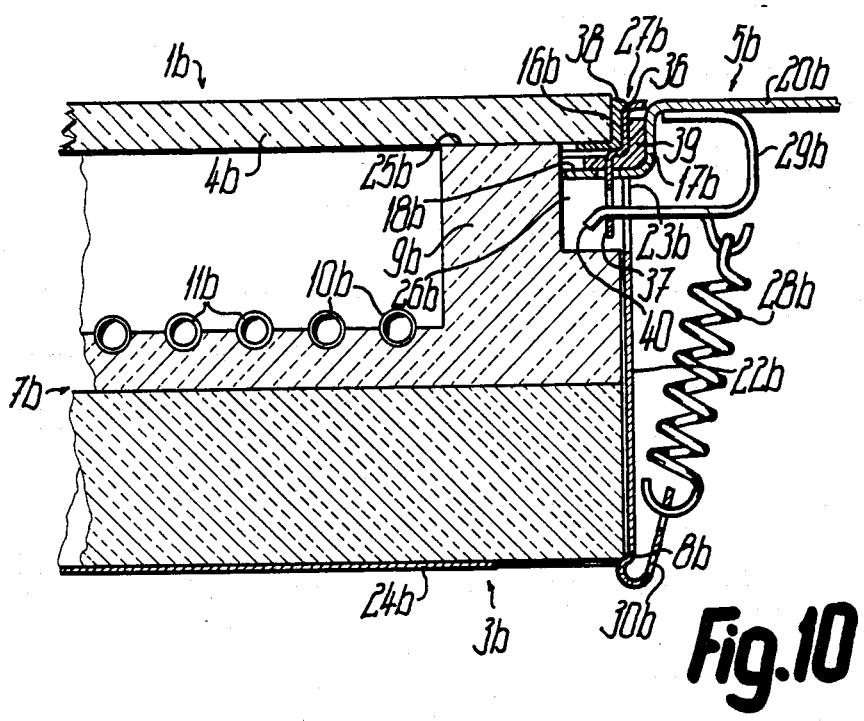
FIG. 10 A detail of another embodiment on a larger scale.

As can be gathered from FIG. 10, in place of a displaceable mounting of support tray 3*b* with respect to frame 5*b*, there can also be a displaceable mounting of hotplate 4*b* with respect to frame 5*b*, a sliding guide 27*b* being formed between these two parts. With a frame-like support 36 made from thin angle or profile metal sheeting substantially covering the edge face 16*b* of hotplate 4*b*, the latter is firmly connected to a constructional unit. The support has in addition to the leg adjacent to the edge face 16*b*, a leg located on the inside of hotplate 4*b* and an outer, outwardly directed shield web, which approximately closes the gap between edge face 16*b* and profile web 17*b* of frame 5*b*. This shield web is the represented embodiment is slightly set back with respect to the outside of the hotplate or is located with its outside roughly in the plane of the outside of cover web 20*b*. Support 36 is connected by an angular bond connected to edge face 16*b* and the inside of hotplate 4*b* to the latter. Between hotplate 4*b* and frame 5*b* is provided an angular sealing profile 39 made from rubber or the like, which is relatively thick or is sufficiently thick that it can be compressed by the necessary amount for readjusting support tray 3*b* relative to hotplate 4*b*. Sealing profile 39 has a profile leg located between profile web 17*b* and edge face 16*b* or support 36 and a profile leg located between web leg 18*b* and the inside of hotplate 4*b* or the underside of support 36 and is completely flush within frame 5*b*, so that the shield web of support 36 with corresponding spacing covers the first-mentioned profile leg on the top surface. Support 36 carries inwardly projecting spring bearings 37 formed from bent out tongues or flaps and which are immediately adjacent to the inside of outer jacket 22*b* of outer tray 8*b* within recess 26*b* of inner tray 7*b*. These spring bearings 37 pass through sealing profile 39 and web leg 18*b* in the vicinity of passage openings and in the vicinity of recess 26*b*, web leg 18*b* can extend so close to the associated, set back outer circumference of the bearing rim 9*b* of inner tray 7*b*, that it and the entire support tray 3*b* is guided in laterally centered manner by the web leg 18*b*. In the represented embodiment, holder 29*b* is substantially U-shaped and fixed with the outside of a leg directed against profile web 17*b* to the inside of cover web 20*b* of frame 5*b*, e.g. by spot welding. Its U-cross web projecting inwards over the inside of cover web 20*b* passes into the second holder leg directed against it from outside the support tray 8*b* and which engages into the interior of outer tray 8*b* through a slot-like opening in outer edge 23*b*. The slot-like openings can be so adapted to the width of holder 29*b*, that the support tray 3*b* is secured or guided with respect to lateral movements by said engagement. The said holder leg forms tension leg 40, whose free end engaging in an opening of spring bearing 37 is supported or articulated in pretensioned manner on support 36 and therefore with respect to hotplate 4b and engages on tension springs 28 outside support tray 3b or outer tray 8b, e.g. by hanging in a hook bent out of the tension leg 40. Holder 29b is elastic in such a way that the tension leg 40 can perform articulated movements about a joint axis located in the vicinity of its transition into the U-cross web located parallel to hotplate 4b or to its edge face 16b. The other end of tension spring 28b is hung in a holder 30b bent in one piece out of the bottom 24b of outer tray 8b. Support tray 3b rests with the end face of outer edge 23b of outer tray 8b remote from bottom 24b on the inside of web leg 18b under the tension of tension spring 28b, so that the position of support tray 3b or outer tray 8b is fixed with respect to frame 5b, but at all times it is possible to raise tray 8b from frame 5b either against the tension of tension spring 28b or after removing said tension spring 28b. Under the tension of tension spring 28b via spring bearing 37, tension leg 40 simultaneously draws support 36 and therefore hotplate 4b against sealing profile 39 in frame 5b, so that if the end face 25b of bearing edge 9b subsides, there is a corresponding adjustment of hotplate 4b with respect to frame 5b, accompanied by the compression of the sealing profile 39. If spring bearing 37 is close enough to the inside of outer tray 8b, it can also form a centring for said outer tray aligning the support tray 3b, said centring acting at right angles to that which is formed by the engagement of tension leg 40 in outer tray 8b.

Figure 11:
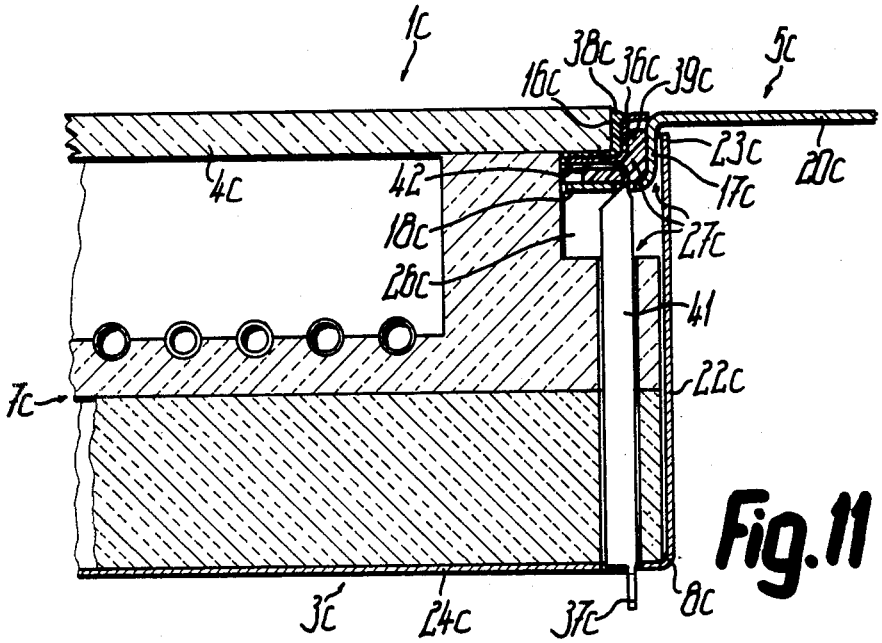
FIGS. 11 to 13 Three further embodiments in representations corresponding to FIG. 10.

The embodiment according to FIG. 11 can either be constructed in such a way that the hotplate 4c is fixed with respect to frame 5c and only the support tray 3c is adjustably mounted with sliding guides or, in addition to the adjustable mounting of support tray 3c, there is an oppositely directed adjustable mounting of hotplate 4c, much as in the embodiment according to FIG. 10. For forming a sliding guide is provided a guide rod 41 e.g. constituted by a bent sheet metal profile which is arranged at right angles to hotplate 4c and completely traverses support tray 3c. Guide rod 41 connected to web leg 18c is at a limited distance from outer jacket 22c of outer tray 8c and traverses a guide channel adapted closely thereto with the necessary movement clearance of the inner tray 7c, as well as the bottom 24c of outer tray 8c, so that immediately below bottom 24c it forms a spring bearing for a tension spring (not shown) supported on the underside of bottom 24c, such as e.g. a leaf spring. If only support tray 3c is adjustably mounted, then the end of guide rod 41 located at hotplate 4c is fixed in stable manner in both directions of its longitudinal extension with respect to frame 5c or hotplate 4c. Said end of guide rod 41 can e.g. be bent to a flange leg 42 directed against the centre of hotplate 4c and which is fixed to the inside of hotplate 4c or the associated leg of support 36c by spot welding or the like, so that guide rod 41 cannot be moved inwards with respect to frame 5c. To prevent outward movements a shoulder of the associated end region of guide rod 41 engages on the inside of web leg 18c. The outer edge 23c of support tray 3c engages over profile leg 17c with bearing clearance, so that support tray 3c is adjustable against the bearing of inner tray 7c on hotplate 4c. If hotplate 4c is adjustably mounted in frame 5c against support tray 3c, then appropriately on guide rod 41 acts a tension spring supported relative to frame 5c and which can e.g. be arranged in recess 26c and then by the other tension spring supported on outer tray 8c, the latter can be adjusted against hotplate 4c. It is also conceivable to provide a tension spring in such a way that it acts both for the adjustment of hotplate 4c and for the adjustment of support tray 3c.

Figure 12:
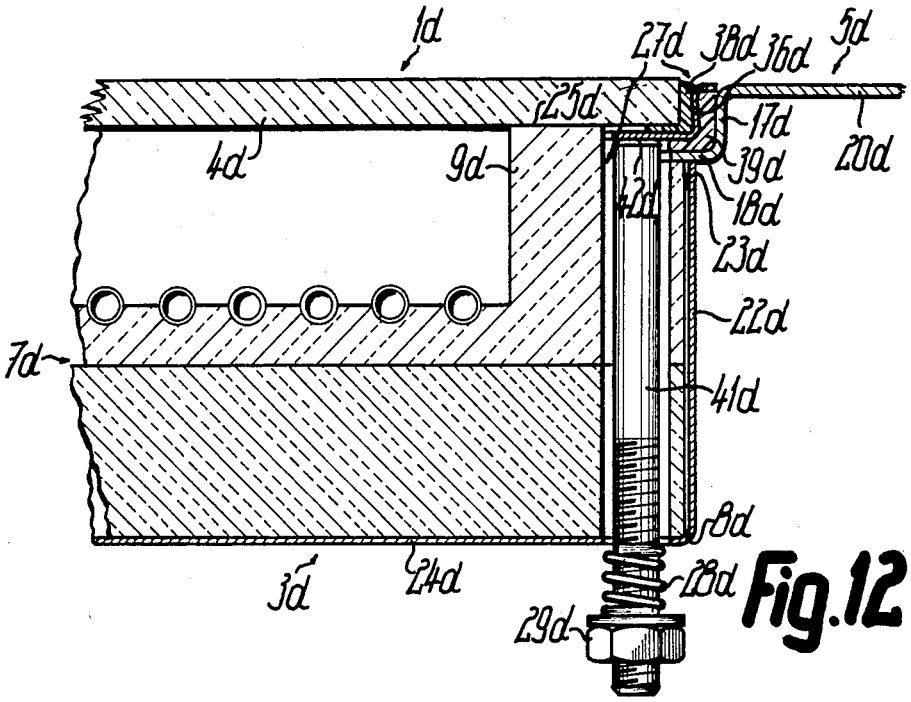

However, guide rod 41d according to FIG. 12 has a solid construction and is e.g. constituted by a threaded spindle, said solid rod being fixed by its end face 42d located at hotplate 4d to the inner leg of support 36d by welding, bonding, rivet joint, threaded engagement or the like. The outer edge 23d of outer tray 3d is once again supported on web leg 18d, so that under the tension of tension springs 28d, hotplate 4d is drawn into frame 5d or against sealing profile 39d. In the present embodiment, tension spring 28d is a helical compression spring surrounding guide rod 41d, which is on the one hand supported on the bottom 24d of outer tray 8d and on the other hand on a counterholder 29d provided on guide rod 41d and which for forming a control member is constituted by a nut making it possible to adjust the pretension of tension spring 28d.

Figure 13:
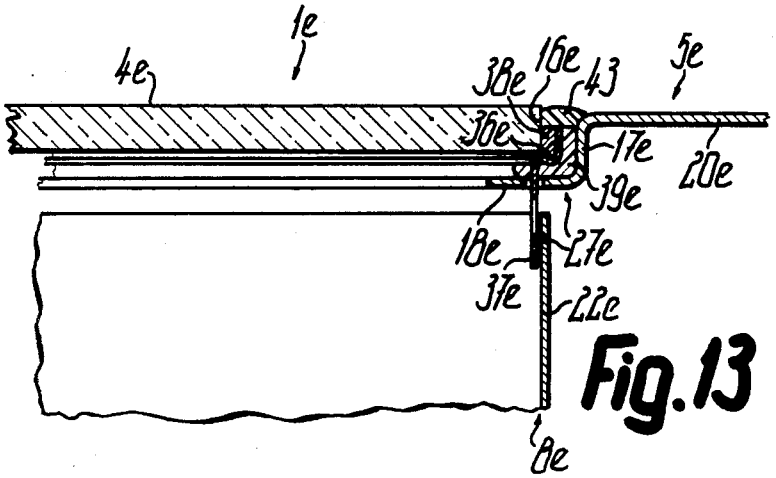

In the embodiment according to FIG. 13 support 36e has no shield web, because it merely has an outer leg running roughly parallel to the edge face 16e of hotplate 4e and terminating between the outside and inside of hotplate 4e. Instead of being closed by the shield web according to FIGS. 10 to 12, the gap between the edge face 16e and the profile web 17e of frame 5e is closed with a cover seal 43 of silicone or the like, which is connected to edge face 16e and completely covers the associated leg end of support 36e. As a result of the described construction, it is easy to replace the hotplate at any time, which particularly facilitates assembly. The tension springs 28b according to FIG. 10 slope outwards, so that with the facing inclined tension springs they secure support tray 3b against lateral movements, i.e. also serve as a guide.

As can be gathered from the left of FIG. 8, outer edge 23 can be provided with an e.g. U-shaped, slipped-on, at least partly elastic profile, e.g. a sealing profile, butt protection profile or the like. This profile e.g. forms a sliding seal with respect to profile web 17 and/or a butt protection with respect to cover web 19, so that the sliding guide is sealed and even if hotplate 4 breaks no liquid can penetrate through the sliding guide into the cooker, whilst a tolerance compensation is also provided. Rim 9 can also be formed by a component made from a better quality or stronger material and which is separate from the remaining inner tray 7.

Figure 14:
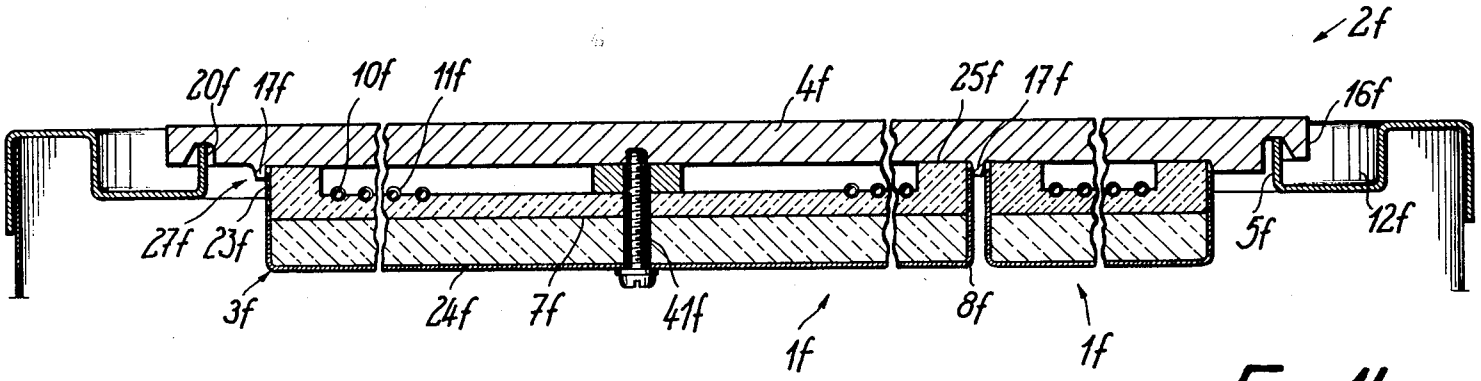
FIG. 14 Another embodiment in section.

The inventive construction is particularly suitable for providing as the hotplate 4f a non-translucent plate made from a metallic material, such as a cast material and especially cast steel. Such plates have a much greater breaking strength than glass ceramic plates, so that they are especially suitable for rough use in industrial or commercial kitchens. This plate can also be grounded in a simple manner and also permits a power increase or a rise in the maximum operating temperature. Furthermore, without risk of damage, the radiant heating resistors 10f, 11f can be located much closer to hotplate 4f than with a glass ceramic plate, so that an extremely shallow construction is obtained, because the outer rim of support tray 3f can also be made lower. Such a construction is shown in FIG. 14, in which the same reference numerals as in the remaining drawings are used for corresponding parts, but are followed by the letter "f".

Although it is conceivable to provide for the guidance of the radiant heater 1f on the inside of hotplate 4f grooves for the engagement of the associated edge zones of outer tray 8f, a much more stable construction is obtained if for guidance purposes profiles 17*f* are provided on the inside of hotplate 4*f* and if said profiles 17*f* are constructed in one piece with hotplate 4*f*. Profiles 17*f* are appropriately web-like or rib-like and have sides inclined in wedge-like manner to the longitudinal edges thereof with an e.g. one degree bevel angle, so that they can be produced in simple manner by casting with the remaining hotplate 4*f*. Profiles 17*f* guide the radiant heaters 1*f* on the outsides of their outer edges 23*f*, there only being a single, common profile web for immediately adjacent radiant heaters 1*f* or the outer edges thereof, although separate, juxtaposed profiles 17*f* in such an area can also be considered. The edge faces of outer rims 23*f* are spaced from the bearing surface of hotplate 4*f* for the end faces 25*f* of inner tray 7*f*, so that under the tension with which the end faces 25*f* engage on hotplate 4*f*, in the case of deflection of said end faces 25*f*, they can be adjusted by this relatively small amount. For the direct fixing of radiant heater 1*f* to hotplate 4*f* in such a way that these two parts form a closed, assemblable, flat constructional unit, it is possible to provide only a single fixing member e.g. in the form of a tensile-stressed clamping bolt 41*f*, which is appropriately located in the centre of support tray 3*f* and completely traverses the bottom thereof, so that it can be supported under pretension on the outside of bottom 24*f* of outer tray 8*f* with a head, a nut or the like. In order that the bottom of inner tray 7*f* does not arch excessively under the fixing tension, it is possible to provide between the inside of the bottom of inner tray 7*f* and the inside of hotplate 4*f* at least one spacer, which e.g. surrounds bolt 41*f* and which appropriately is made from insulating material and can also be constructed in one piece with the associated layer of inner tray 7*f*. In this case the spring tension for the optionally necessary minor self-adjustment of support tray 3*f* with respect to hotplate 4*f* can be provided by inner bracing of said tray 3*f*, so that no separate spring element is required. In the represented embodiment, clamping bolt 41*f* is a threaded bolt, whose threaded shank is directly screwed into a tapped hole on the planar inside of hotplate 4*f* between profiles 17*f*. However, clamping bolt 41*f* can also be a stay bolt with a nut screwed onto the outside of support tray 3*f*, which is e.g. fixed by welding to the inside of hotplate 4*f*, so that there is no cross-sectional weakening thereof. The tapped hole can also be provided in a shoulder projecting in one piece over the inside of hotplate 4*f* and which can also form the spacer.

The profiling for the engagement of the outer shield provided on the rim of hotplate 4*f* can also be in one piece with the latter in the represented embodiment and for this purpose it is provided on the inside with corresponding longitudinal grooves 20*f* adjacent to the edge faces 16*f* thereof. However, in place of this, for the leg of frame 5*f* engaging in the inside of hotplate 4*f* and directed against the inside of the latter, a corresponding, e.g. rib-like shoulder could be provided on the inside of hotplate 4*f*, which approximately engages in said inside up to the bend of the leg. The frame 5*f* directly engaging in hotplate 4*f* can be constructed in one piece with the outer shield or the collecting channel 12*f*, so that no separate frame parts are required of this. As a result of the ribs or profiles 17*f*, which pass into one another in gap-free manner and at an angle at the intersection points and therefore in each case define an e.g. rectangular or square reception field for the associated radiant heater 1*f*, it is also possible to achieve an advantageous stiffening of hotplate 4*f*, so that it can be made relatively thin, have a low weight and also a low heat capacity or absorption. The outermost profile of hotplate 4*f* adjacent to the particular edge face 16*f* can either be rib-like, as shown to the left in FIG. 4, or as shown to the right in FIG. 4 can be wider with respect to its height so that it extends approximately up to the reception profiling for frame 5*f*. The radiant heating elements 10*f*, 11*f* are appropriately arranged in such a way that there is a central field no occupied by heating resistors and whose width is greater than the ring width of the heated field surrounding same in circular manner. In said central field can be provided a thermostat (not shown), e.g. a thermal cutout, such as an expansion rod regulator, in such a way that the rod-like thermostat is very close to the inside of hotplate 4*f* and the regulator casing carrying the thermostat is arranged in the central field. For protecting the regulator casing or the switch parts located therein, the central field can be shielded with a web made from insulating material or the like with respect to the heated field, said web appropriately extending from the inner tray 7*f* to the inside of hotplate 4 and can be circular, so that a completely closed chamber for receiving the thermal cutout is formed. The web can also serve as the spacer for supporting the central region of the support tray 3*f* with respect to hotplate 4*f*.

I claim:

1. A radiant heating unit (2) for cooking and similar appliances, comprising:

a hotplate (4) having an inner side, an outer side and an edge face (16);

at least one radiant heater (1) having at least one radiant heating element (10,11) defining a heating field;

a support tray (3) having a bearing rim (9) formed from an insulating material and surrounding the heating field, an end face (25) of said bearing rim (9) engaging on the inner side of the hotplate (4);

said support tray (3) receiving the radiant heater (1) and having a base side facing the hotplate;

wherein said bearing rim (9) is at least slightly shrinkably compressible over a predetermined maximum amount, and further comprising guiding means laterally slidably guiding said hotplate (4) and said support tray (3) permanently with respect to each other in a self-adjusting centering manner over a distance at least equal to said maximum amount.

2. A radiant heating unit according to claim 1, wherein the guiding means (27) laterally centers the support tray (3).

3. A radiant heating unit according to claim 1, wherein the guiding means (27) mount the support tray (3) such that the support tray is resiliently adjustably displaceable substantially at right angles to the hotplate (4).

4. A radiant heating unit according to claim 1, wherein the guiding means (27) is located substantially between the outer side of the hotplate (4) and the base side of the support tray (3).

5. A radiant heating unit according to claim 1, wherein the hotplate (4) is a cooker plate defining cooking points, said hotplate (4) extending over a number of the cooling points.

6. A radiant heating unit according to claim 1, wherein a frame (5*b*) receives the hotplate (4*b*) in a centering manner.

7. A radiant heating unit according to claim 6, further comprising a sealing profile (39) interposed between the hotplate (4*b*) and the frame (5*b*).

8. A radiant heating unit according to claim 6, wherein said hotplate (46) engages on said frame with one side, the hotplate being resiliently pressed against the frame in the vicinity of its inner side.

9. A radiant heating unit according to claim 6, wherein at least one guiding means (27*c*) is provided between the frame (5*c*) and the support tray (3*c*).

10. A radiant heating unit according to claim 6, wherein at least one guiding means (27*c*) is provided between the frame (5*c*) and the hotplate (4*c*).

11. A radiant heating unit according to claim 6, wherein the frame has an at least partly U-profile-shaped frame web (19) located between adjacent hotplates (4) and forming guiding means (27) for support trays (3) positioned adjacent to one another.

12. A radiant heating unit according to claim 6, wherein a base (6) is provided for carrying said radiant heating unit, said frame (5) being adjustably arranged at right angles to the hotplate (4) with respect to a base (6).

13. A radiant heating unit according to claim 6, wherein said frame (5*f*) engages in the inner side of the hotplate (4*f*), the frame forming an outer shield for the hotplate (4*f*) defining a spillage channel (12*f*) surrounding the hotplate (4*f*).

14. A radiant heating unit according to claim 1, wherein the support tray (3*b*) and the hotplate (4*b*) are resiliently braced against one another.

15. A radiant heating unit according to claim 1, wherein at least one guiding means (27 or 27*c*) is linked to the hotplate (4,4*c*).

16. A radiant heating unit according to claim 1, wherein at least one guiding means (27,27*c*) is provided directly adjacent to the hotplate (4 or 4*c*) and is connected thereto.

17. A radiant heating unit according to claim 1, wherein the support tray (3 or 3*b*) has an insulating material inner tray (7 or 7*b*) providing the bearing rim (9 or 9*b*) and has an outer tray (8 or 8*b*) receiving the inner tray, an outer rim (23 or 23*b*) of the outer tray being located adjacent to the hotplate (4 or 4*b*) and displaceably engaging in at least one guiding means (27 or 27*b*).

18. A radiant heating unit according to claim 17, further comprising a seal member sealing the outer rim (23,23*b*).

19. A radiant heating unit according to claim 17, wherein the frame has a rim profile extending inwards from the outside of the hotplate (4 or 4*b*) and is part of a frame profile supporting the hotplate, the outer tray (8 or 8*b*) of the support tray (3 or 3*b*) cooperating with at least one of the rim profile and a mounting (36) therefor.

20. A radiant heating unit according to claim 17, wherein the outer tray (8) has an inside and the guiding means (27) is web-like, said guiding means (27) engaging on the inside of the outer tray (8) and said bearing rim (9) being recessed in the vicinity of the guiding means (27).

21. A radiant heating unit according to claim 1, wherein the guiding means (27) is at least partly set back with respect to the inner side of the hotplate (4).

22. A radiant heating unit according to claim 1, wherein the guiding means extends substantially up to the outer side of the hotplate (4).

23. A radiant heating unit according to claim 1, wherein the hotplate (4*b*) is at least partly framed by a frame-like mounting (36) which forms a preassembled bonded constructional unit with the hotplate (4*b*).

24. A radiant heating unit according to claim 23, wherein the mounting (36) at least partly bears the guiding means (27*b*) and a spring bearing (37).

25. A radiant heating unit according to claim 23, wherein the mounting (36) is located in substantially flush manner in the frame (5*b*) and at most extends up to the outer side of the hotplate (4*b*).

26. A radiant heating unit according to claim 1, wherein the support tray (3 or 3*b*) is associated with a substantially size-corresponding hotplate (4 or 4*b*) defining one of a number of cooking points.

27. A radiant heating unit according to claim 1, wherein at least one of the guiding means (27*c* or 27*e*) is inwardly displaced with respect to the edge face (16*c* or 16*e*) of the hotplate, the guiding means being located substantially on the inner side of the hotplate (4*c*, 4*e*).

28. A radiant heating unit according to claim 1, wherein an end of the guiding means is fixed with respect to one of the inner side of the hotplate (4*c* or 4*e*) and its mounting (36*c* or 36*e*).

29. A radiant heating unit according to claim 1, wherein the support tray (3*d*) cooperates with at least one guide rod (41*d*) substantially at right angles to the hotplate (4*d*) and at least partly traversing an inner tray (70) of the support tray.

30. A radiant heating unit according to claim 1, wherein at least one guiding means (27) is located directly adjacent to the edge face (16) of the hotplate (4), said guiding means (27) engaging behind the hotplate (4) with a web leg (18).

31. A radiant heating unit according to claim 1, wherein at least one tension spring (28*a*) supported with respect to the base (6*a*) is provided for pressing the bearing rim (9*a*) against the hotplate (4*a*).

32. A radiant heating unit according to claim 1, wherein said guiding means (27*f*) is formed by rib-like profiles (17*f*) on the inner side of the hotplate (4*f*).

33. A radiant heating unit according to claim 1, wherein said support tray (3*f*) has an outside, said guiding means (27*f*) engaging on said outside of the support tray (3*f*).

34. A radiant heating unit according to claim 1, wherein the support tray (3*f*) is tensioned against the hotplate (4*f*) by means of at last one tensioning bolt member (41*f*) substantially directly engaging in the hotplate (4*f*) and transversing the support tray (3*f*) at a distance from the bearing rim (9*f*).

35. A radiant heating unit according to claim 1, wherein the hotplate (4*f*) is made from a metallic material.

* * * * *

UNITED STATES PATENT AND TRADEMARK OFFICE

CERTIFICATE OF CORRECTION

PATENT NO. : 4,788,414

DATED : November 29, 1988

INVENTOR(S) : Felix Schreder

It is certified that error appears in the above-identified patent and that said Letters Patent is hereby corrected as shown below:

Column 10, line 9 delete "no" and insert --not--.

Column 11, line 2 delete "46" and insert --4b--.

Column 12, line 54 delete "last" and insert --least--.

Signed and Sealed this

Seventeenth Day of October, 1989

*Attest:*

DONALD J. QUIGG

*Attesting Officer*

*Commissioner of Patents and Trademarks*